US011279589B2

(12) United States Patent
Klipfel

(10) Patent No.: US 11,279,589 B2
(45) Date of Patent: Mar. 22, 2022

(54) METHOD FOR SUPPLYING A CONTINUOUS SHEET OF AEROSOL-FORMING SUBSTRATE FROM A BOBBIN AND AEROSOL-GENERATING ARTICLE

(71) Applicant: PHILIP MORRIS PRODUCTS S.A., Neuchatel (CH)

(72) Inventor: Yorick Klipfel, St. Saphorin-sur-Morges (CH)

(73) Assignee: Philip Morris Products S.A., Neuchatel (CH)

( * ) Notice: Subject to any disclaimer, the term of this patent is extended or adjusted under 35 U.S.C. 154(b) by 536 days.

(21) Appl. No.: 15/769,136

(22) PCT Filed: Oct. 21, 2016

(86) PCT No.: PCT/EP2016/075307

§ 371 (c)(1),
(2) Date: Apr. 18, 2018

(87) PCT Pub. No.: WO2017/068091

PCT Pub. Date: Apr. 27, 2017

(65) Prior Publication Data

US 2018/0303151 A1 Oct. 25, 2018

(30) Foreign Application Priority Data

Oct. 22, 2015 (EP) ..... 15190933

(51) Int. Cl.
*A24B 3/14* (2006.01)
*B65H 49/06* (2006.01)
(Continued)

(52) U.S. Cl.
CPC ..... *B65H 49/06* (2013.01); *A24B 3/14* (2013.01); *A24C 5/01* (2020.01); *B65H 49/14* (2013.01); *B65H 2801/54* (2013.01)

(58) Field of Classification Search
CPC ..... A24B 3/14; B65H 49/06; B65H 49/14; B65H 2801/54; B65H 16/04;
(Continued)

(56) References Cited

U.S. PATENT DOCUMENTS 3,467,108 A * 9/1969 Wallace ..... A24C 1/30 131/59
5,699,812 A * 12/1997 Bowen et al. ..... A24B 3/14 131/297
(Continued)

FOREIGN PATENT DOCUMENTS

EP 1693126 8/2006
EP 1992239 11/2008
(Continued)

OTHER PUBLICATIONS

Mechanical English Translation of JP 2002187657 (GOOGLE/EPO) printed from the Internet on Apr. 6, 2021; http://translationportal.epo.org/emtp/translate/? ACTION=description-retrieval&COUNTRY=JP&ENGINE=google&FORMAT=docdb&KIND =A&LOCALE=en EP&NUMBER=20021 87657&OPS=ops.epo.org/3.2&SRCLANG=ja&TRGLANG=en (Year: 2002).*
(Continued)

*Primary Examiner* — Michael H. Wilson
*Assistant Examiner* — Dionne W. Mayes
(74) *Attorney, Agent, or Firm* — Mueting Raasch Group

(57) ABSTRACT

The method for supplying a continuous sheet of aerosol-forming substrate (10) from a bobbin (1) comprises providing a bobbin (1) of continuous sheet of aerosol-forming substrate (10) and unwinding the continuous sheet of aerosol-forming substrate (10) from a center (11) of the bobbin (1). Preferably, rotational movement of the bobbin (1) is prevented during unwinding of the continuous sheet of aerosol-forming substrate (10).

9 Claims, 3 Drawing Sheets

(51) Int. Cl.
*A24C 5/01* (2020.01)
*B65H 49/14* (2006.01)

(58) Field of Classification Search
CPC ..... B65H 16/103; B65H 2301/441; B65H 2515/50; A24C 5/005; A24C 5/20
USPC ..... 131/370
See application file for complete search history.

(56) References Cited

U.S. PATENT DOCUMENTS

| | | | | |
|---|---|---|---|---|
| 6,289,897 | B1 | 9/2001 | McAdam | |
| 2006/0019548 | A1 | 8/2006 | Strickland | |
| 2007/0204869 | A1* | 9/2007 | Sampson | A24D 1/02 131/274 |
| 2011/0192408 | A1 | 8/2011 | Inagaki | |
| 2011/0259352 | A1* | 10/2011 | Woodcock et al. | A24D 1/02 131/337 |
| 2015/0150302 | A1* | 6/2015 | Metrangolo | A24B 13/00 131/77 |

FOREIGN PATENT DOCUMENTS

| | | |
|---|---|---|
| EP | 2151408 | 2/2010 |
| JP | 2001-501452 | 2/2001 |
| JP | 2002-187657 | 7/2002 |
| JP | 2015-517817 | 6/2015 |
| WO | WO 95/27411 | 10/1995 |
| WO | WO 2010/047389 | 4/2010 |
| WO | WO 2013/178767 | 12/2013 |

OTHER PUBLICATIONS

PCT Search Report and Written Opinion for PCT/EP2016/075307 dated Feb. 8, 2017 (10 pages).
Office Action issued in Japan for Application No. 2018-515786 dated Nov. 9, 2020 (14 pages). English translation included.

* cited by examiner

METHOD FOR SUPPLYING A CONTINUOUS SHEET OF AEROSOL-FORMING SUBSTRATE FROM A BOBBIN AND AEROSOL-GENERATING ARTICLE

This application is a U.S. National Stage Application of International Application No. PCT/EP2016/075307, filed Oct. 21, 2016, which was published in English on Apr. 27, 2017, as International Publication No. WO 2017/068091 A1. International Application No. PCT/EP2016/075307 claims priority to European Application No. 15190933.0 filed Oct. 22, 2015.

The invention relates to a method for supplying a continuous sheet of aerosol-forming substrate from a bobbin. The invention further relates to an aerosol-generating article, in particular manufactured using said method.

In the manufacture of aerosol-generating products, sheets of aerosol-forming substrates, for example tobacco substrates, so-called 'cast leaf' may be used. Cast leaf is manufactured from a tobacco containing slurry, which slurry is spread into a sheet and dried. The so formed cast leaf is wound to bobbins for further use, for example, for being crimped, cut or gathered and, for example, formed into tobacco plugs. Such tobacco plugs in turn may be used in consumables for electronic aerosol-generating devices. However, cast leaf tends to be tacky and has low tensile strength, which complicates handling and may slow down a processing speed of a consumable manufacturing process.

Therefore, it would be desirable to improve the handling of sheets of aerosol-forming substrates, in particular of cast leaf.

According to an aspect of the invention, there is provided a method for supplying a continuous sheet of aerosol-forming substrate from a bobbin. The method comprises the steps of providing a first bobbin of continuous sheet of aerosol-forming substrate and unwinding the continuous sheet of aerosol-forming substrate from a center of the first bobbin. Preferably, a further step of the method may comprise preventing rotational movement of the first bobbin during unwinding of the continuous sheet of aerosol-forming substrate. This may, for example, be done by keeping the first bobbin stationary while unwinding the continuous substrate from the first bobbin.

The central unwinding of the sheet material provides the sheet with a twisted form. Due to the twisting of the continuous sheet, a crimping or providing an overlying structure for supporting a forming or gathering of the sheet may be omitted. Accordingly, any mechanical devices for crimping or structuring the continuous sheet may be omitted, simplifying an apparatus set-up and reducing acquisition and maintenance costs.

An aerosol-generating article manufactured with the twisted sheet of aerosol-forming substrate, the article may include a porosity due to the twisted nature of the unwound substrate. For example, a rod formed by gathering the unwound substrate may include longitudinally arranged channels along the twisted substrate. Such porosity of an aerosol-generating article may be favourable in view of aerosol transport through the article. Porosity may also be used for altering a resistance to draw in an aerosol-generating article comprising or being made of a sheet of aerosol-forming substrate unwound from the center of a bobbin.

With a central unwinding, the continuous sheet of aerosol-forming substrate is not pulled in parallel from and to an underlying sheet (which corresponds to the rotation direction of a rotating bobbin). Instead, when the continuous sheet is unwound from the center of the bobbin, the sheet is pulled from the underlying sheet at an angle to said parallel direction (that is, to the imaginary rotation direction of the bobbin). Thus, pulling forces are reduced in central unwinding compared to pulling forces occurring upon pulling a sheet from an outside of a rotating bobbin. Such reduced pulling forces are in particular favourable for tacky aerosol-forming substrates and, alternatively or in addition, for aerosol-forming substrates having low mechanical properties, such as, for example, cast leaf.

Unwinding a bobbin from its center may also eliminate the requirement to rotate the bobbin. By this, rotating or moving parts of an apparatus for unwinding a bobbin may not be required. In addition, any drive for rotating a bobbin may be omitted. This further simplifies a set-up of an apparatus as well as its maintenance. Yet further, energy consumption and costs of an apparatus may be reduced.

If the bobbins are not rotated, larger and heavier bobbins may be used than in known applications, since the bobbins do not have to be rotated and may still be used even when being slightly deformed, for example having a shape being rather ovoid than round.

With the method according to the invention, a faster supply of a sheet of aerosol-forming substrate from a bobbin is enabled, enhancing a production speed of, for example, an aerosol-generating article being made of or comprising such a sheet of aerosol-forming substrate.

An 'aerosol-forming substrate' is a substrate capable of releasing volatile compounds that can form an aerosol. Volatile compounds may be released by heating or combusting the aerosol-forming substrate. As an alternative to heating or combustion, in some cases volatile compounds may be released by a chemical reaction or by a mechanical stimulus, such as ultrasound. An aerosol-forming substrate may be solid. An aerosol-forming substrate may be adsorbed, coated, impregnated or otherwise loaded onto a carrier or support. An aerosol-forming substrate may comprise plant-based material, for example a homogenised plant-based material. The plant-based material may comprise tobacco, for example homogenised tobacco material. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise at least one aerosol-former. The aerosol-forming substrate may comprise nicotine and other additives and ingredients, such as flavourants. Preferably, the aerosol-forming substrate is a tobacco sheet such as a cast leaf tobacco. Cast leaf tobacco is a form of reconstituted tobacco that is formed from a slurry including tobacco particles, fiber particles, aerosol formers, flavors, and binders. Tobacco particles may be of the form of a tobacco dust having a particle size preferably in the order between 30-80 micrometer or 100-250 micrometer, depending on the desired sheet thickness and casting gap. Fiber particles may include tobacco stem materials, stalks or other tobacco plant material, and other cellulose-based fibers, such as wood fibers having a low lignin content. Fiber particles may be selected based on the desire to produce a sufficient tensile strength for the cast leaf versus a low inclusion rate, for example, a rate between approximately 2 percent to 15 percent. Alternatively or additionally, fibers, such as vegetable fibers, may be used either with the above fibers or in the alternative, including hemp and bamboo.

Preferably, sheets of homogenised tobacco material for use in an aerosol-generating article are formed from a slurry comprising particulate tobacco, guar gum, cellulose fibres and glycerine by a casting process.

Aerosol formers may be added to the slurry that forms the cast leaf tobacco. Functionally, the aerosol former should be capable of vaporizing within the temperature range at which the cast leaf tobacco is intended to be used in the tobacco product, and facilitates conveying nicotine or flavour or both nicotine and flavour, in an aerosol when the aerosol former is heated above its vaporization temperature. The aerosol former is preferably chosen based on its ability to remain chemically stable and essentially stationary in the cast leaf tobacco at or around room temperature, but which is able to vaporize at a higher temperature, for example, between 40 degree and 450 degree Celsius.

As used herein, the term aerosol refers to a colloid comprising solid or liquid particles and a gaseous phase. An aerosol may be a solid aerosol consisting of solid particles and a gaseous phase or a liquid aerosol consisting of liquid particles and a gaseous phase. An aerosol may comprise both solid and liquid particles in a gaseous phase. As used herein both gas and vapour are considered to be gaseous.

The aerosol-generating substrate may have an aerosol former content of between 5 percent and 30 percent on a dry weight basis. In a preferred embodiment, the aerosol-generating substrate has an aerosol former content of approximately 20 percent on a dry weight basis.

Preferably, the aerosol-forming substrate comprises an aerosol former.

As used herein, the term 'aerosol former' is used to describe any suitable known compound or mixture of compounds that, in use, facilitates formation of an aerosol and that is substantially resistant to thermal degradation at the operating temperature of the aerosol-generating article. Preferably, the aerosol former is polar and is capable of functioning as a humectant, which can help maintain moisture within a desirable range in the cast leaf tobacco. Preferably, a humectant content in the cast leaf tobacco is in a range between 15 percent and 35 percent.

Suitable aerosol-formers are known in the art and include, but are not limited to: polyols, glycol ethers, polyol ester, esters, fatty acids and monohydric alcohols, such as menthol and may comprise one or more of the following compounds: polyhydric alcohols, such as propylene glycol; glycerin, erythritol, 1,3-butylene glycol, tetraethylene glycol, triethylene glycol, triethyl citrate, propylene carbonate, ethyl laurate, triacetin, meso-erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol former may be combined to take advantage of one or more properties of the combined aerosol formers. For example, triacetin may be combined with glycerin and water to take advantage of the triacetin's ability to convey active components and the humectant properties of the glycerin.

Cast leaf material tends to be tacky and be plastically deformable.

Preferably, the continuous sheet of aerosol-forming substrate comprises tobacco material and an aerosol former.

The sheet of aerosol-forming substrate may have a thickness between 0.1 millimeter and 2 millimeter, preferably between 0.3 millimeter and 1.5 millimeter, for example, 0.8 millimeter. The sheet of aerosol-forming substrate may have deviations in thickness of up to about 30 percent due to manufacturing tolerances.

The width of a sheet of aerosol-forming substrate may be chosen and adapted to its application and a manufacturing process of a product comprising one or several sheets of aerosol-forming substrate. Preferably, a width of a sheet of aerosol-forming substrate is smaller the more sheets are used for manufacturing a product. For example, if only one sheet of aerosol-forming substrate is used, the width of the single sheet may be in a range between 150 millimeter and 250 millimeter. An aerosol-generating article may also be manufactured, for example by braiding, as will be described in detail below, using for example two to six, preferably three to four bobbins of sheets of aerosol-forming substrate. The width of a sheet of aerosol-forming substrate may then preferably be in a range of 20 millimeter to 70 millimeter, more preferably in a range of 25 millimeter to 45 millimeter.

For unwinding the sheet of aerosol-forming substrate, the first bobbin may be arranged in any direction. The first bobbin may, for example, be arranged such that its rotational axis is arranged in a horizontal position or in a vertical position or in any position between the horizontal and the vertical position. Preferably, the continuous sheet of aerosol-forming substrate is unwound from the first bobbin substantially along the rotational axis of the first bobbin.

As used herein, by 'substantially along the rotational axis' it is meant that the difference in an unwinding direction and a direction of the rotational axis of the bobbin the continuous sheet is unwound from, is less than about 10 degree. Preferably, an unwinding direction and a direction of rotational axis of a bobbin correspond to each other.

Preferably, the rotational axis of the first bobbin is aligned in a horizontal direction or in a vertical direction. Thereby, the first bobbin is preferably unwound in a horizontal direction or in a vertical direction.

Arranging and unwinding a bobbin in a horizontal direction may be favourable in view of an overall horizontal set-up of a manufacturing line for, for example, aerosol-generating articles. A horizontally unwound continuous sheet may be transported in a horizontal linear direction, for example, to a rod making machine for forming a rod. Alignment or deflection elements may thus be omitted.

With an unwinding of a bobbin in a downward vertical direction gravitational force may support the unwinding and transport direction. Unwinding a bobbin in an upward vertical direction may be supported by an upwardly directed gas stream, for example through the center of the vertically arranged bobbin. If a vertically unwound sheet shall be further transported or, for example introduced into a rod making apparatus in a horizontal position, deflection elements may be provided. Deflection elements may deflect the vertically unwound sheet of aerosol-forming substrate into a horizontal position for further processing of the unwound sheet.

The method according to the invention may comprise the further steps of providing a second bobbin of continuous further material, unwinding the continuous further material from the second bobbin and merging unwound continuous sheet of aerosol-forming substrate and unwound continuous further material. Advantageously, the continuous further material is also unwound from the center of the second bobbin. The second bobbin may preferably be kept stationary or may at least be prevented from rotating when unwinding the further material from the second bobbin.

'Merging' as used herein may very generally be understood as bringing together two or more continuous solids, wherein continuous solid is herein used to refer to any continuous further material or continuous sheet of aerosol-forming substrate. Merging may include bringing together adjacently, intertwined merging or interlacing such as braiding. Merging is also understood to include merging of already merged materials, for example the merging of a merged strand of material with a continuous solid or with another merged strand of continuous solids.

An intertwining of at least two continuous solids may be performed, for example, by rotating at least two unwound continuous solids around a common rotational axis. For a braiding, supplied unwound continuous solids from a center of bobbins does not necessarily require rotation of the bobbins around their rotational axis. The positions of the bobbins used for braiding may be varied according to a pattern to be braided. Positions of bobbins may be varied, for example on a rotating table. Such braiding techniques are known from, for example, rope manufacturing. They may be applied to the present invention, however, taking into account the sheet-like form as well as the mechanical strength of the continuous solids used for the merging, in particular, a braiding process.

'Twisting' is herein understood as full rotations of a continuous solid along a longitudinal axis of the continuous solid, in particular of a continuous sheet of aerosol forming substrate. A twisting is a continuous twisting in one rotational direction only of a continuous solid. Different continuous solids may be twisted in different rotational directions when seen in a transport direction of the solids. Preferably, the twisting includes at least one full rotation of the continuous solid over 1 meter length of continuous solid.

A twisting varies according to the size of a circumference of the center of a bobbin, thus a rotation per length of unwound continuous sheet varies depending on a size and status of a bobbin (fresh bobbin versus used-up bobbin). However, twisting differences that might lead to irregularities in structure and density of a final product manufactured from the twisted sheet may be compensated by various means. For example, when using several sheets of continuous solid, differently sized bobbins or bobbins in different status may be used, such that any twisting differences may be levelled out along a length of the merged unwound sheets. Another possibility is to slightly rotate a bobbin to compensate for a varying center circumference of a bobbin. A rotational speed may be varied during the use of the bobbin preferably to keep a twisting of the unwound continuous material from the bobbin at a constant level. However, a rotational speed of a bobbin may also be varied during the use of the bobbin to compensate a varying twisting of another bobbin. By this, only one or several bobbins may be provided with a rotating system.

The continuous further material may be one of a continuous susceptor material, a continuous carrier material or a continuous sheet of aerosol-forming substrate.

By merging a continuous susceptor material with the continuous sheet of aerosol-forming substrate an inductively heatable aerosol-forming substrate is formed. The merging of the two continuous solids, in particular the merging of a susceptor material and an aerosol-forming substrate provides a close contact of the two solids. An inductively heatable aerosol-generating article formed from or containing such an inductively heatable aerosol-forming substrate may have a good heat distribution and a homogeneous temperature distribution over a cross-section or length of the article.

Preferably, the continuous further material is a susceptor material, for example a ferromagnetic tape.

A susceptor material may, for example, have the form of a filament, rod, sheet or band.

Suitable inductively heatable materials, so-called susceptors include but are not limited to any material that can be inductively heated to a temperature sufficient to generate an aerosol from the aerosol-forming substrate. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius.

A continuous carrier material may be a material carrying an additive, such as for example a flavour or aerosol-enhancing agent. A carrier material may also support a structure or stability of a strand formed by merging the continuous sheet of aerosol-forming substrate and the carrier material and possibly further continuous material. A carrier material may, for example, have the form of a filament, rod, sheet or band.

A continuous further material in the form of a further sheet of aerosol-forming substrate may be favourable in view of a composition or in view of a porosity of a merged strand formed by two sheets of aerosol-forming substrate or of an aerosol-generating article formed with the merged strand. Two or more aerosol-forming substrates to be merged together may be identical or may be different. Due to the twisted form of an unwound substrate, additional porosity may be introduced into a strand also by the merging of two identical (twisted) substrates.

A merging of two or more continuous solids may occur upstream of, for example, a rod-forming apparatus or any other manufacturing step for forming an aerosol-generating article. A merging of two or more continuous solids may also occur in a rod-forming apparatus. Thereby, the two or more continuous solids are merged by the gathering effect of a garniture tongue of such a rod-forming apparatus.

As used herein, the terms 'upstream' and 'downstream' when used to describe the relative positions of elements refer to the direction in which the continuous sheet of aerosol-forming substrate or continuous further material move during the supply and transporting process. That is, continuous solid moves in a downstream direction from an upstream end to a downstream end. Typically, a bobbin is arranged at an upstream end of supply or processing line.

For unwinding and merging the continuous sheet of aerosol-forming substrate and the continuous further material, the rotational axis of the first and second bobbins may be aligned on a common axis or may be arranged under an angle.

If the rotational axis of the first bobbin and the rotational axis of the second bobbin is arranged under an angle, this is preferably done such that the unwound continuous sheet of aerosol-forming substrate and the unwound continuous further material may be merged under a merging angle between 5 degree and 90 degree. Preferably, a merging angle is between 10 degree and 70 degree, more preferably between 15 degree and 45 degree, for example 30 degree or 40 degree.

The angle under which the rotational axis of the first and second bobbin are arranged is preferably the same as the merging angle. However, the angle under which the rotational axis of the first and second bobbin are arranged may be different than the merging angle. Such an arrangement angle may, for example, be between 0 degree and 180 degree. If an arrangement angle is larger than 90 degrees, preferably deflection devices, for example deflection rollers, are provided for deflecting either one or both of the aerosol-forming substrate or the further material, such that a merging angle is within the above indicated limits.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

If a rotational axis of the first bobbin and the rotational axis of the second bobbin is aligned on a first common axis, the method may comprise the step of guiding either unwound continuous further material or unwound continuous sheet of aerosol-forming substrate from an upstream arranged bobbin along the first common axis through the center of a downstream arranged bobbin. A further step comprises merging unwound continuous sheet of aerosol-forming substrate and unwound continuous further material forming a merged strand.

By guiding continuous solid unwound from an upstream arranged bobbin through the center of a downstream arranged bobbin, no redirecting of the upstream unwound continuous solid is required for aligning the two unwound continuous solids. A merging of the two unwound continuous solids, namely the unwound continuous sheet of aerosol-forming substrate and the unwound continuous further material, may occur at the center of the downstream arranged bobbin or shortly thereafter. A so formed merged strand comprises at least two continuous solids unwound from bobbins and merged together. A merged strand may comprise several continuous solids merged together or may comprise two of more merged strands as will be described below.

With bobbins arranged on a common axis, the unwinding direction and supply direction preferably corresponds to the direction along that common axis.

Preferably, the continuous sheet of aerosol-forming substrate or first bobbin is arranged downstream of the continuous further material or second bobbin and the continuous further material is guided through the center of the first bobbin.

In some embodiments of this method, the method may comprise the further steps of aligning at least one further bobbin of continuous further material with its at least one rotational axis along the first common axis upstream of the first bobbin and second bobbin and guiding unwound continuous further material from more upstream arranged bobbins through centers of more downstream arranged bobbins. Thereby, the at least one unwound continuous further material from the at least one more upstream arranged bobbin is merged with unwound continuous further material from more downstream arranged bobbins and unwound continuous sheet of aerosol-forming substrate or with a merged strand.

With at least one further bobbin arranged on a first common axis, the unwinding and supply direction preferably corresponds to the direction along the first common axis.

The continuous further material from the at least one further bobbin is preferably unwound from the center of the at least one further bobbin. The at least one further bobbin is preferably kept stationary or is preferably at least prevented from rotating when unwinding the further continuous material from the at least one further bobbin.

The at least one further bobbin may comprise the same or different continuous solids than the first and second bobbin. For example, the at least one further bobbin may comprise a continuous sheet of aerosol-forming substrate or a continuous susceptor material or a carrier material.

Preferably, a most downstream arranged bobbin is the first bobbin or a bobbin comprising a continuous sheet of aerosol-forming substrate. Preferably, bobbins with an aerosol-forming substrate and bobbins comprising a different continuous solid (different than an aerosol-forming substrate) are arranged in an alternating manner.

Continuous sheet of aerosol-forming substrate on different bobbins may be identical, for example in composition and density. Preferably, continuous sheet of aerosol-forming substrate on different bobbins differ in at least one of composition, porosity or sheet dimensions, such as sheet thickness or width.

The method according to the invention may further comprise the steps of providing one or several additional bobbins of continuous further material at an angle to the first common axis. The unwound continuous further material from the one or from the several additional bobbins is merged with the merged strand under a merging angle of between 5 degree and 90 degree.

If several additional bobbins are provided, preferably the several additional bobbins are aligned with their rotational axis on a second common axis. If the additional bobbins are arranged on a second common axis, preferably, continuous solid from upstream arranged bobbins are guided through the center of downstream arranged bobbins.

If two or more additional bobbins are provided at an angle to the first common axis, preferably, an additional merged strand is formed with the continuous solids unwound from the two or more additional bobbins. The additional merged strand and the merged strand may then be merged instead of merging individual unwound continuous solids.

Preferably, a merging angle is selected to provide enough space to arrange bobbins of different sizes next to each other.

Preferably, continuous further material is unwound from the one or several additional bobbins from the center of the bobbins. The one or several additional bobbins are preferably kept stationary or are preferably at least prevented from rotating when unwinding the continuous further material from the one or several additional bobbins.

The continuous further material on the one or several additional bobbins may be the same as on the first and second bobbin, as well as on further bobbins arranged on the first common axis. Preferably, the continuous further material on the one or several additional bobbins are sheets of aerosol-forming substrate, susceptor material or carrier material.

The method according to the invention may be used in the manufacture of aerosol-generating articles, preferably tobacco containing aerosol-generating articles. One or several unwound continuous solids or one or several merged strands may be supplied to, for example, a rod forming apparatus, to form, for example, a tobacco containing rod. Preferably, the method according to the invention is used in the manufacture of inductively heatable aerosol-generating articles.

The special supply of continuous solid, in particular of several continuous solids allows to manufacture different pattern geometries, longitudinally as well as over a cross section of an aerosol forming article. By this, structures of aerosol forming articles may have physical properties not available in prior art articles. For example, several continuous solids may be intertwined or braided, for example, similar to ropes. Such structures may have specific physical properties. They may, for example, have a certain elasticity. In addition, a susceptor material or also a flavourant or other material may be homogeneously incorporated in an aerosol-generating article having a repeatable, consistent pattern of susceptor material and further material merged with each other.

According to another aspect of the invention, there is provided an aerosol-generating article for use in an aerosol-generating device, for example an electronic heating device. The aerosol-generating article comprises a twisted sheet of aerosol-forming substrate. Preferably, the twisted sheet of aerosol-forming substrate is a compressed twisted sheet of aerosol-forming substrate. The sheet of aerosol-forming substrate is twisted along a longitudinal direction of the aerosol-generating article, wherein the twisting occurs in a same rotational direction along the longitudinal direction of the article. A twisting may occur in the aerosol-generating article such that the sheet of aerosol-forming substrate is rotated along the longitudinal direction of the article by at least 5 degrees, preferably by at least 10 degree over a length of the aerosol-generating article.

The aerosol-generating article may comprise one or several further materials, preferably one or several twisted further materials. Preferably, the aerosol-generating article comprises one further material, more preferably one twisted further material. Preferably, the one or several further material is a portion of a sheet, preferable twisted sheet, of continuous material, for example, a strip or twisted strip. However, the further materials may also be a filament, rod or pin.

The aerosol-generating article according to the invention may comprise a portion of a merged strand comprising the sheet of aerosol-forming substrate and comprising the twisted further material, wherein the merged strand may be manufactured using the method according to the invention and as described herein for supplying continuous sheet of aerosol-forming substrate.

The aerosol-generating article may also comprise a portion of at least one additional merged strand, wherein the at least one additional merged strand comprises a twisted sheet of aerosol-forming substrate.

Preferably, the aerosol-generating article comprises an intertwined or braided structure. The intertwined or braided structure extends along a length of the aerosol-generating article.

Preferably, the further material is a susceptor material, preferably a susceptor strip, thus forming an inductively heatable aerosol-generating article.

Further aspects and advantages of the aerosol-generating article have already been mentioned relating to the method according to the invention and will not be repeated. In particular, choice and arrangement of different continuous solids may be selected according to a user's need or according to a desired aerosol generation performance or a consuming experience.

The invention is further described with regard to embodiments, which are illustrated by means of the following drawings, wherein.

Figure 1:
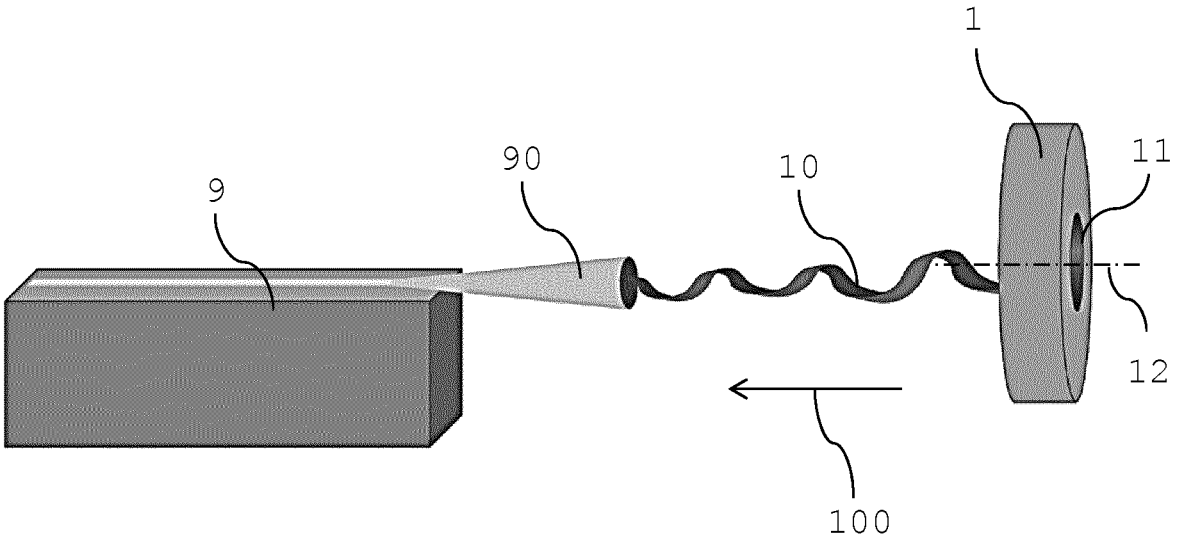
FIG. 1 shows a central unwinding of a bobbin of continuous sheet of aerosol-forming substrate in a horizontal direction.

In FIG. 1 a bobbin 1 of a continuous sheet of aerosol-forming substrate 10, for example a nicotine or tobacco containing aerosol-forming substrate, is unwound from the center 11 of the bobbin 1. The bobbin 1 is arranged with its rotational axis 12 oriented in a horizontal direction. The unwinding direction 100 of the sheet of aerosol-forming substrate 10 corresponds to the horizontal direction. The unwound sheet of aerosol-forming substrate 10 is transported linearly in a horizontal direction to a rod making machine 9. The sheet of aerosol-forming substrate 10 enters a garniture tongue 90 of the rod making machine 9, wherein the sheet 10 is gathered and formed into a rod shape.

During unwinding of the sheet 10, preferably the bobbin 1 is kept stationary such that the unwound sheet has a twisted form, that is, the sheet is rotated around its longitudinal axis or along the unwinding direction, respectively. One entire twist then corresponds to a 360 degree rotation of the sheet around its longitudinal axis and to an unwinding of the sheet once around the circumference of the center 11 of the bobbin 1.

Figure 2:
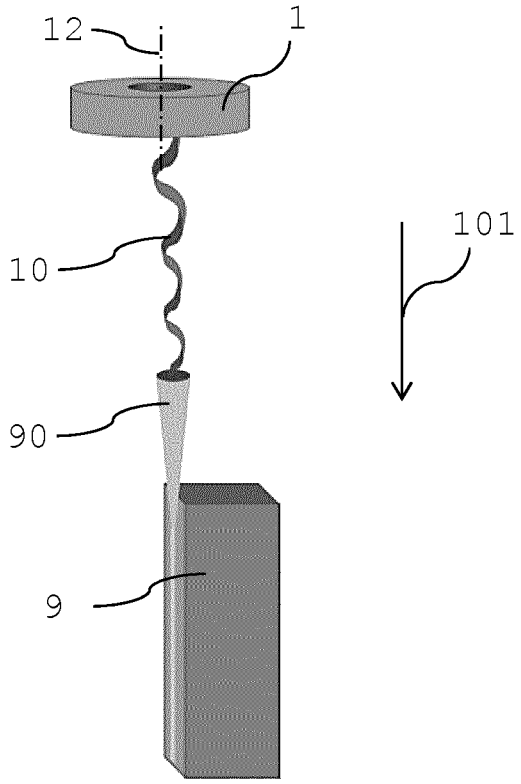
FIG. 2 shows a central unwinding of a bobbin of continuous sheet of aerosol-forming substrate in a vertical direction.

FIG. 2 shows the same arrangement as FIG. 1 but with the bobbin 1 being arranged with its rotational axis 12 oriented in a vertical direction. The sheet of aerosol-forming substrate 10 is unwound downwards in the vertical direction 101 and is guided into the garniture tongue 90 of the rod-making machine 9. In the embodiment shown in FIG. 2, gravitational force supports the unwinding. In combination with a linear insertion of the sheet of aerosol-forming substrate 10 into the garniture tongue 90, also an alignment of the sheet 10 with the garniture tongue 90 is supported.

Figure 3:
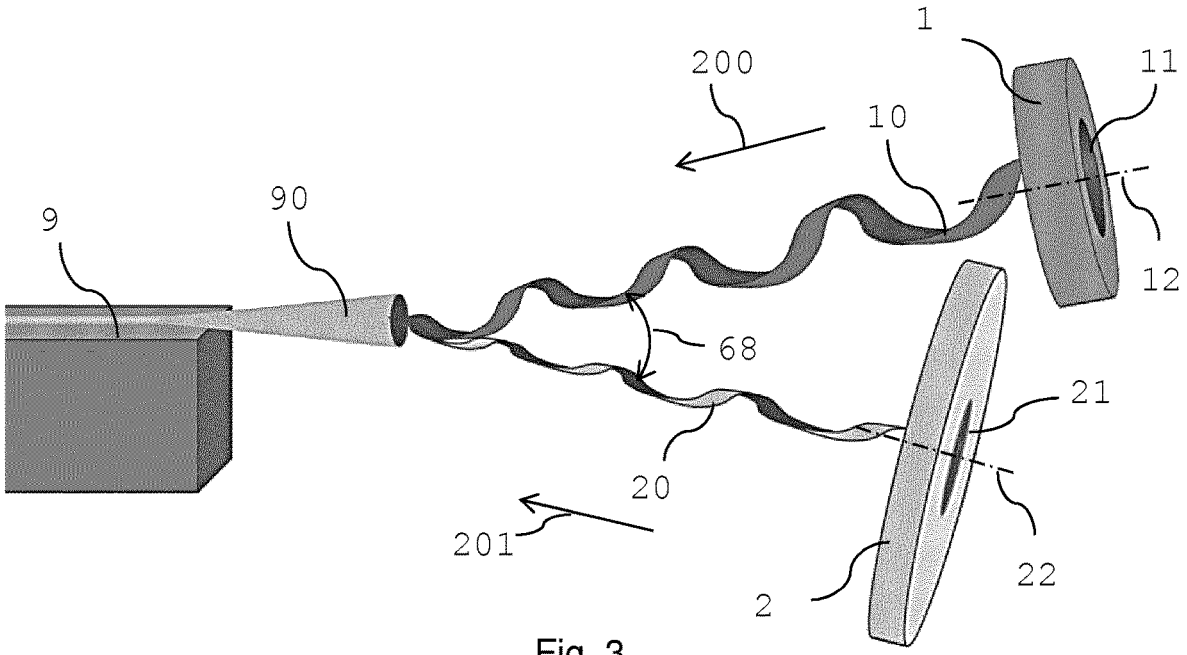
FIG. 3 shows supply of aerosol-forming substrate and a further material under an angle.

FIG. 3 shows a method for manufacturing a rod-shaped article comprising a sheet of aerosol-forming substrate 10 and comprising a continuous further material. Therein, the sheet of aerosol-forming substrate 10 and a sheet of continuous further material 20, for example a continuous band of susceptor material, are supplied from the center 11,21 of two bobbins 1,2.

The two continuous solids 10,20 are transported to a garniture tongue 90, wherein the two solids are merged. The two continuous solids are supplied to the garniture tongue 90 under a merging angle 68. In FIG. 3, the merging angle 68 is about 30 to 45 degrees, depending on the arrangement and sizes of the bobbins 1,2.

The sheet of aerosol-forming substrate 10 is unwound from the center 11 of bobbin 1 in an unwinding and transporting direction 200. The sheet of further material 20 is unwound from the center 21 of bobbin 2 in an unwinding and transporting direction 201. The two unwinding direction 200, 201 encompass an angle corresponding to the merging angle. In FIG. 3, the merging angle 68 corresponds to the angle under which the bobbin 1 of aerosol-forming substrate and bobbin 1 of continuous further material are arranged. This is due to the fact that both continuous solids are unwound in a linear direction parallel to the rotational axis 12,22 of the corresponding bobbins 1,2.

The angle under which the bobbins 1,2 are arranged may also be smaller or larger than the merging angle 68, and may, for example, be in a range between 5 degree to 160 degree.

Figure 5:
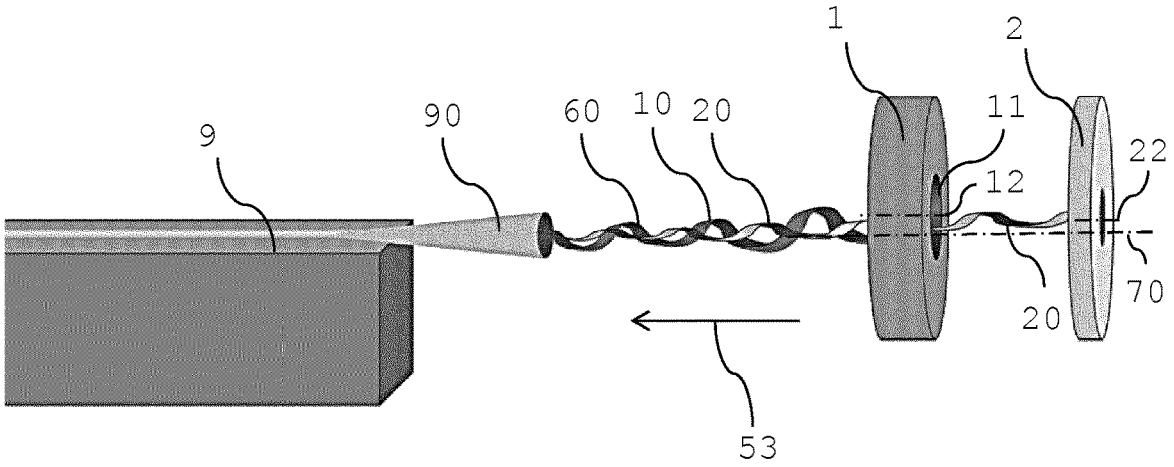
FIG. 5 shows supply of aerosol-forming substrate and a further material along a common axis.

FIG. 5 shows the supply of a continuous sheet of aerosol-forming substrate 10 and a continuous sheet of further material 20 along a horizontally arranged common axis 70. The bobbin 2 of further material is arranged upstream of the bobbin 1 of aerosol-forming substrate. The rotational axis 12,22 of both bobbins 1,2 are arranged parallel to the common axis 70. The sheet of further material 20, for example a band of susceptor material, is unwound from the center of bobbin 2. The unwound sheet of further material 20 is guided along the common axis 70 downstream through the center 11 of the more downstream arranged bobbin 1 of aerosol-forming substrate. The sheet of aerosol-forming substrate 10 is unwound from the center 11 of bobbin 1 and merged with the unwound sheet of further material 20. Sheet of aerosol-forming substrate 10 and sheet of further material 20 form a merged stand 60. The merged strand 60 is then guided further along the common axis 70 into the garniture tongue 90 of a rod-making machine 9, where a rod is formed from the merged strand.

Figure 6:
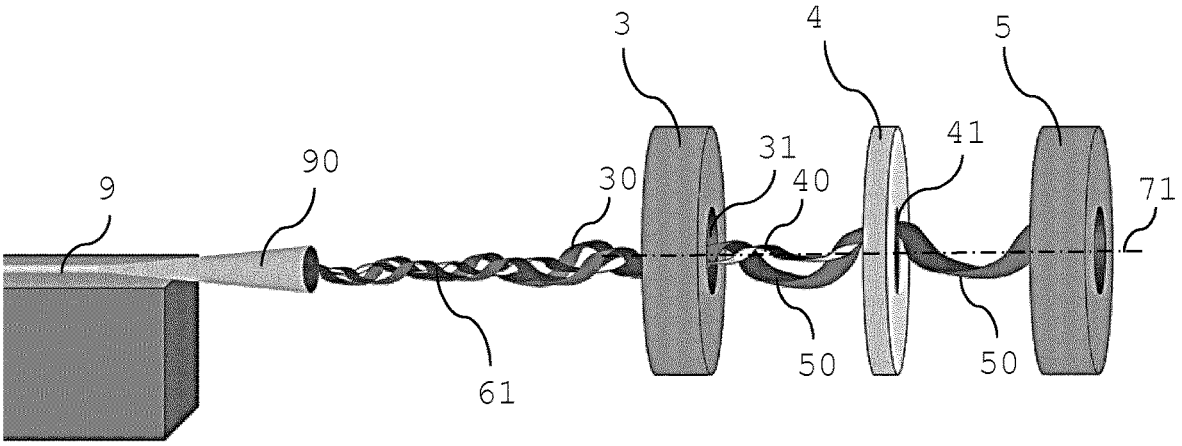
FIG. 6 illustrates the manufacturing of a merged strand by supply of three continuous solids along a common axis.

FIG. 6 shows the method of FIG. 5, wherein three bobbins 3,4,5 are arranged serially, preferably equidistantly along a common axis 71. Unwound solid from the three bobbins 3,4,5 form a strand 61 comprising three continuous sheets of solid.

Compared to the method shown in FIG. 5, a further bobbin 5 of aerosol-forming substrate is arranged upstream of the bobbin 4 of continuous further material. Aerosol-forming substrate is unwound from bobbin 5 and guided along the common axis 71 thought the center 41 of bobbin 4. There, the unwound sheet of aerosol-forming substrate 50 is merged with the unwound sheet of further material 40. This partial strand is guided further downstream through the center 31 of bobbin and is merged with the unwound sheet of aerosol-forming substrate 30 unwound from bobbin 3.

In a series of bobbins, preferably similar or identical materials are arranged in alternating manner with a bobbin of a continuous further material. Similar or identical materials may, for example, be two identical or different aerosol-forming substrates or two identical or different susceptor materials. In a series of bobbins, all bobbins may comprise entirely distinct solids. For example, a series of three bobbins may comprise an aerosol-forming substrate, a susceptor material and a carrier material, for example a flavour carrier material.

Figure 4:
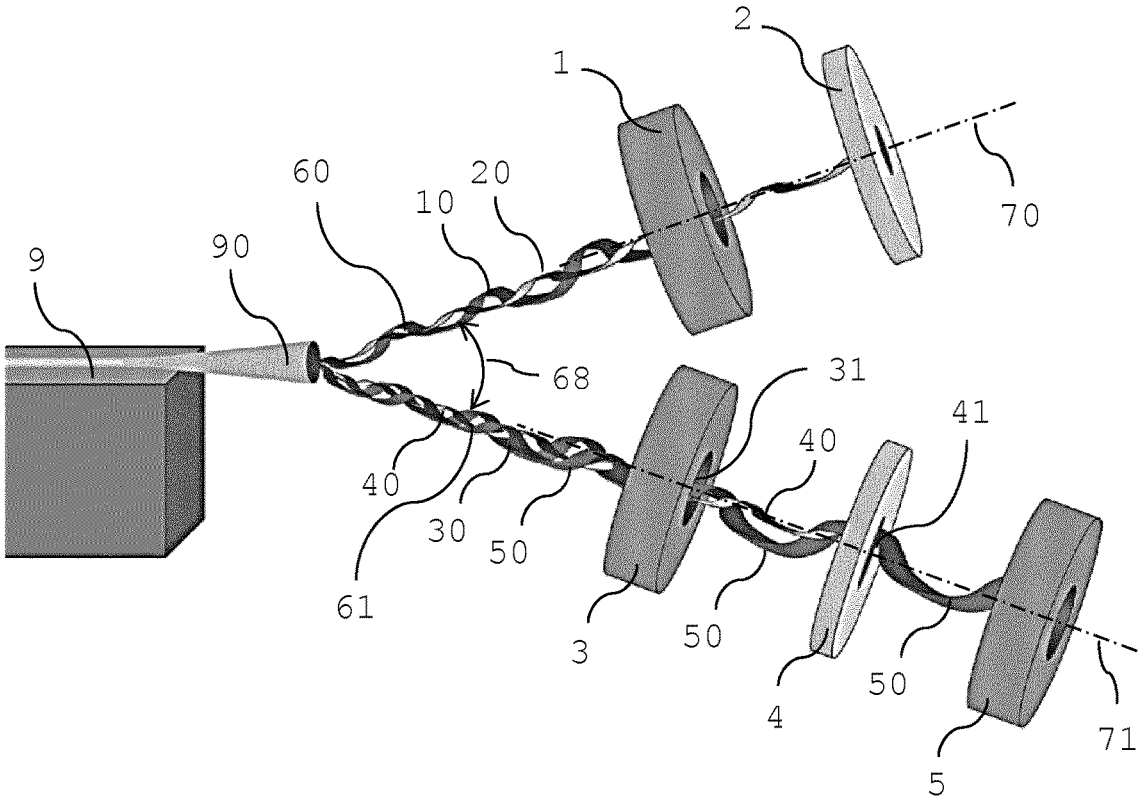
FIG. 4 illustrates the manufacturing of two merged strands of continuous solids, wherein the two strands are merged under an angle.

In FIG. 4 a manufacturing process for a rod-shaped article is shown using two merged strands 60,61 formed according to the methods shown and described in FIG. 5 and FIG. 6.

In the example shown in FIG. 4, two merged strands 60, 61 are merged under the merging angle 68, for example 30 degree to 70 degree, while entering the garniture tongue 90 of the rod-making machine 9. Thus, a rod-shaped article manufactured in the rod-making machine 9 is formed of two merged strands 60,61 and of a total of five continuous solids, for example, five different continuous solids, wherein at least one continuous solid is a continuous sheet of aerosol-forming substrate. In FIG. 4 the first strand 60 preferably comprises a sheet of aerosol-forming substrate 10 and a band of susceptor material 20, while the second strand 61 preferably comprises two sheets of aerosol-forming substrate 30,50 and a band of susceptor material 40.

In FIG. 4, two bobbins 1,2 are arranged along a first common axis 70 and three bobbins 3,4,5 are arranged along a second common axis 71. The first common axis 70 and the second common axis 71 are arranged at an angle corresponding to the merging angle 68. The continuous solids are all unwound from their corresponding bobbins 1,2,3,4,5 and in a direction along their respective common axis 70,71.

Preferably, in all the methods described, shown in the drawings and in variants thereof, continuous solid is unwound from the center of a bobbin.

Preferably, in all the methods described, shown in the drawings and in variants thereof, all bobbins are kept stationary while unwinding continuous solid from a bobbin. Keeping stationary is herein understood in view of a rotation around the rotational axis of the bobbin. However, a bobbin may be kept entirely fixed or may, for example, be moved in order to twist, intertwine or braid unwound continuous solids with each other (while the bobbins are preferably not rotated around their rotational axis).

Preferably, continuous solids on different bobbins are different, for example different in view of composition, size or shape. In particular, if two or more sheet of aerosol-forming substrate are used for manufacturing a merged strand or a rod-shaped article, preferably, the two or more sheet of aerosol-forming substrate are different, for example different in composition, size or aerosolization profile.

The invention claimed is:

1. Method for supplying a continuous sheet of aerosol-forming substrate from a bobbin, the method comprising:

providing a first bobbin of continuous sheet of aerosol-forming substrate;

unwinding the continuous sheet of aerosol-forming substrate from a center of the first bobbin;

providing a second bobbin of continuous further material, wherein the continuous further material comprises one of a continuous susceptor material or a continuous carrier material, and the continuous further material comprises a metal;

unwinding the continuous further material from the second bobbin; and merging the unwound continuous sheet of aerosol-forming substrate and the unwound continuous further material.

2. Method according to claim 1, further comprising the step of preventing rotational movement of the first bobbin during unwinding of the continuous sheet of aerosol-forming substrate.

3. Method according to claim 1, wherein the continuous sheet of aerosol-forming substrate comprises tobacco material and an aerosol former.

4. Method according to claim 1, further comprising the step of aligning the rotational axis of the first bobbin in a horizontal direction or in a vertical direction, and unwinding the first bobbin in a horizontal direction or in a vertical direction.

5. Method according to claim 1, further comprising the step of arranging the rotational axis of the first bobbin and the rotational axis of the second bobbin under an angle, such that the unwound continuous sheet of aerosol-forming substrate and the unwound continuous further material are merged under a merging angle between 5 degree and 90 degree.

6. Method according to claim 1, further comprising the steps of:

aligning the rotational axis of the first bobbin and the rotational axis of the second bobbin along a first common axis;

guiding either unwound continuous further material or unwound continuous sheet of aerosol-forming substrate from an upstream arranged bobbin along the first common axis through the center of a downstream arranged bobbin; and merging unwound continuous sheet of aerosol-forming substrate and unwound continuous further material forming a merged strand.

7. Method according to claim 6, further comprising the steps of:

aligning at least one further bobbin of continuous further material with its at least one rotational axis along the first common axis upstream of the first bobbin and the second bobbin;

guiding unwound continuous further material from more upstream arranged bobbins through centers of more downstream arranged bobbins;

merging at least one unwound continuous further material from the at least one more upstream arranged further bobbin with unwound continuous further material and unwound continuous sheet of aerosol-forming substrate from more downstream arranged bobbins.

8. Method according to claim 6, further comprising the steps of:

providing and arranging one or several additional bobbins of continuous further material with their rotational axis at an angle to the first common axis, and merging unwound continuous further material from the one or several additional bobbins with the merged strand under a merging angle between 5 degree and 90 degree.

9. The method of claim 1, wherein the metal is a ferromagnetic material.

* * * * *